US005169604A

United States Patent [19]

Crothers, Jr.

[11] Patent Number: 5,169,604

[45] Date of Patent: Dec. 8, 1992

[54] CATALYTIC CONVERTER WITH REPLACEABLE CARRIER ASSEMBLY

[75] Inventor: William J. Crothers, Jr., Berlin, Md.

[73] Assignee: Johnson Matthey, Inc., Malvern, Pa.

[21] Appl. No.: 784,995

[22] Filed: Oct. 30, 1991

[51] Int. Cl.[5] ..... F01N 3/15

[52] U.S. Cl. ..... 422/177; 422/179; 422/180; 422/190; 422/193; 60/295; 60/299; 60/301

[58] Field of Search ..... 422/177, 180, 179, 190, 422/193; 60/299, 301, 295

[56] References Cited

U.S. PATENT DOCUMENTS

| | | | |
|---|---|---|---|
| 2,718,460 | 9/1955 | Bowen, III | 422/179 |
| 3,938,232 | 2/1976 | Noda et al. | 29/890 |
| 4,220,625 | 9/1980 | Toh et al. | 422/180 |
| 4,238,455 | 12/1980 | Ogiwara | 422/171 |
| 4,239,733 | 12/1980 | Foster et al. | 422/179 |
| 4,269,807 | 5/1981 | Bailey et al. | 422/179 |
| 4,322,386 | 3/1982 | Masutomi et al. | 422/171 |
| 4,407,785 | 10/1983 | Pfefferle | 423/659 |
| 4,536,371 | 8/1985 | Thayer et al. | 422/171 |
| 4,581,206 | 4/1986 | Otani et al. | 422/171 |
| 4,709,549 | 12/1987 | Lepperhoff | 60/295 |
| 4,843,815 | 7/1989 | Smojver | 60/299 |
| 4,849,185 | 7/1989 | Wittig | 422/171 |

*Primary Examiner*—Lynn M. Kummert

*Attorney, Agent, or Firm*—Cushman, Darby & Cushman

[57] ABSTRACT

An apparatus for effecting high temperature catalytic conversion treatment of combustion exhaust gasses flowing in an exhaust path of an industrial installation which comprises a housing assembly including a fixed housing unit forming a fixed part of a gas exhaust path defining an opening, the housing assembly includes a cover member mounted on the fixed housing unit for movement from an operative position closing the opening to an open position providing access to an interior space within the fixed housing unit through the opening. A mounting assembly is provided for mounting one or more catalytic carrier assemblies stably both axially and peripherally within the housing assembly so that exhaust gasses flow only through passages in the catalytic carrier assemblies in operation. The mounting assembly enables the catalytic carrier assembly to be removed from the interior space of the fixed housing unit through the opening when the cover member is moved to the open position for servicing while the fixed housing unit remains fixed within the gas flow path to receive another catalytic carrier assembly.

15 Claims, 4 Drawing Sheets

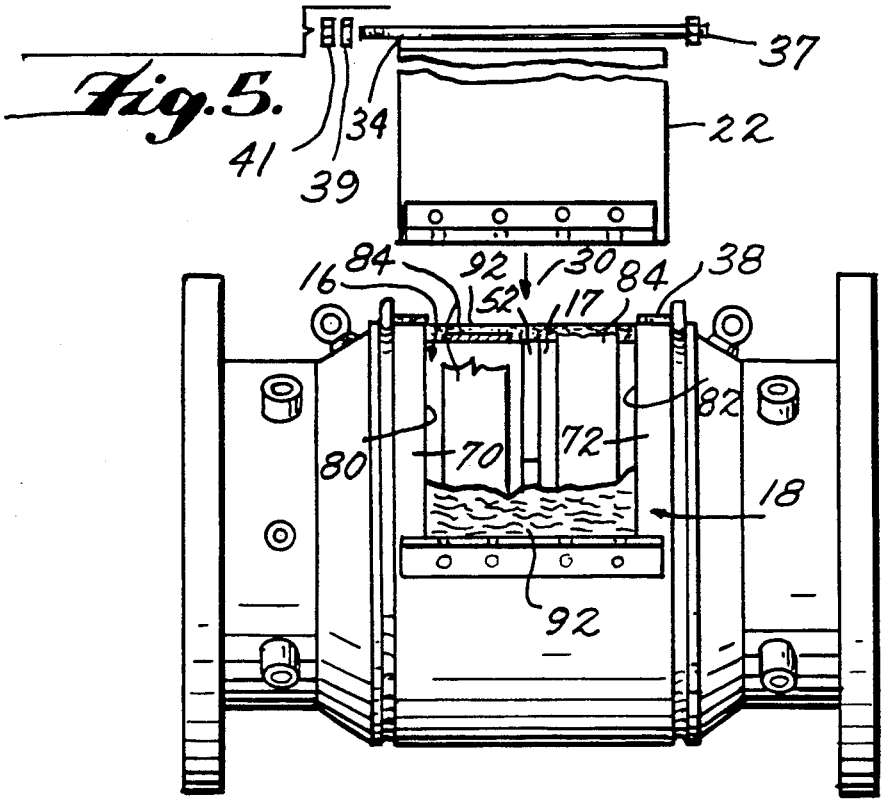
Fig. 5.
Fig. 6.
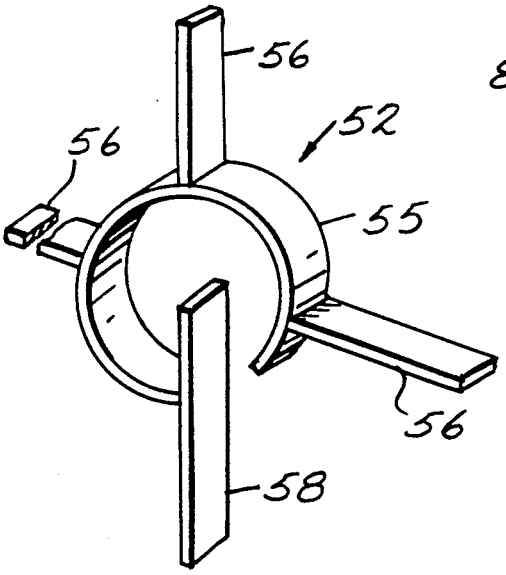
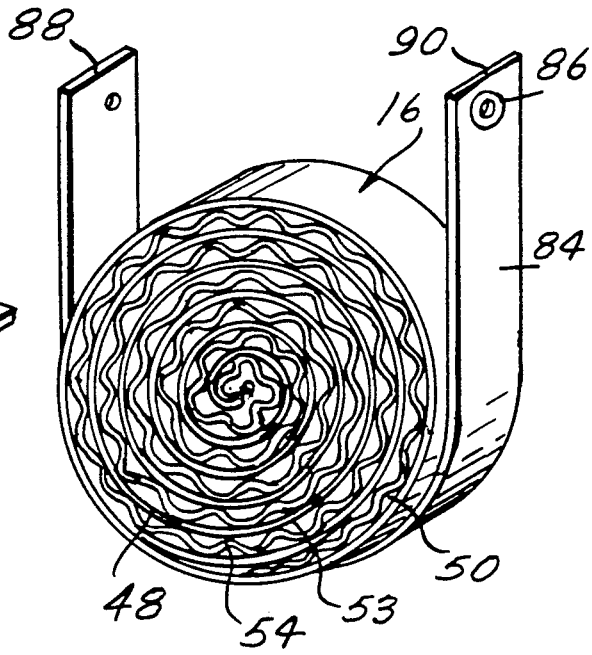
Fig. 7.

CATALYTIC CONVERTER WITH REPLACEABLE CARRIER ASSEMBLY

This invention relates to catalytic converters and more particularly to industrial style catalytic converters adapted to effect high temperature catalytic treatment of combustion exhaust gasses.

The type of industrial catalytic converter installation herein contemplated is smaller than the very large industrial installations such as exemplified in commonly assigned U.S. Pat. No. 4,849,185. The installation of the patent involves the use of 1,152 catalytic carrier units, each of which is 2 feet by 2 feet or approximately 3.8 square feet. The present application contemplates one or a few catalytic carrier units having a range of effective catalyst areas from 0.20 square feet to 3.6 square feet. The basic catalytic apparatus herein described has an effective area of 1.2 square feet, enclosed in a housing in excess of two feet in length. Thus, the size range of the present invention is closer to automotive size than the large industrial size.

Catalyst-type exhaust gas purifiers familiar to most people are utilized in automobiles. U.S. Pat. No. 3,938,232 discloses catalyst-type exhaust gas purifier used in an automobile, which is comprised of a divisible vessel for holding an integrated catalyst. In the arrangement of this patent, the method of manufacturing the assembly incorporates a vessel divisible in two halves, which are joined together to form the casing of the assembly. In these automobile catalytic converters, once the catalyst has become depleted by use, the entire catalytic converter is removed from the exhaust path and replaced by a new one. Thus, the servicing of an automotive-type converter presents the same problems as any other type of automotive part servicing.

In larger industrial installations, the time required to service the catalytic converter is time taken away from the commercial operation of the installation. In the larger industrial installations containing a great multiplicity of catalytic carrier units, downtime for servicing can be severe simply because of the logistics involved. The problem is particularly acute when the multiplicity of catalytic carrier units are built up one upon the other into a bedlike structure, as, for example, as shown in U.S. Pat. No. 2,718,460. There have been disclosed several improvements in the patented literature for more effectively dealing with the multiplicity of catalytic carrier units utilized in these larger installations. Examples, in addition to the improvement disclosed in U.S. Pat. No. 4,849,185, are contained in U.S. Pat. Nos. 4,238,455 and 4,322,386.

The present invention focuses upon the smaller industrial installations where catalytic converters are utilized which contain one or a few cylindrical-type catalytic carriers in a size range approaching automotive converters where servicing has been done in a manner similar to automotive converters (remove and replace) but which, in reality, present downtime problems which are very much like those of the larger installations. A need exists to improve servicing and minimize downtime for industrial-type catalytic converters within the cylindrical unit size range.

An object of the present invention is to fulfill the need referred to above. In accordance with the principles of the present invention, this objective is obtained by providing an apparatus for effecting high temperature catalytic conversion treatment of combustion exhaust gasses flowing in an exhaust path of an industrial installation which comprises a housing assembly including a fixed housing unit forming a fixed part of a gas exhaust path having a fixed inlet to receive the gasses in the exhaust path and a fixed outlet for exhausting treated gasses into the exhaust path and a fixed central portion between the inlet and outlet defining an opening, the housing assembly includes a cover member mounted on the fixed housing unit for movement from an operative position closing the opening to an open position providing access to an interior space within the fixed housing unit through the opening; and a catalytic carrier assembly having a cylindrical periphery of a size sufficient to pass through the opening, the catalytic carrier assembly includes a generally cylindrical structure having a multiplicity of passages extending therethrough for flow of exhaust gasses therethrough, and a catalyst carried by the structure so as to be contacted by the gasses flowing through the passages; and a mounting assembly cooperable with the cylindrical periphery of the catalytic carrier assembly and with the fixed housing unit and cover member when in the operative position, for mounting said catalytic carrier assembly stably both axially and peripherally within the housing assembly so that exhaust gasses flow only through the passages in operation. The mounting assembly enables the catalytic carrier assembly to be removed from the interior space of the fixed housing unit through the opening when the cover member is moved to the open position for servicing while the fixed housing unit remains fixed within the gas flow path to receive another catalytic carrier assembly.

Another object of the invention is it further improve servicing and minimize downtime for industrial catalytic converters, including the larger industrial installations, regardless of the configuration of the catalytic carrier assembly. In accordance with the principles of the present invention, this objective is obtained by providing an apparatus for effecting high temperature catalytic conversion treatment of combustion exhaust gasses flowing in an exhaust path of an industrial installation which comprises a housing assembly including a fixed housing unit forming a fixed part of a gas exhaust path having a fixed inlet to receive the gasses in the exhaust path and a fixed outlet for exhausting treated gasses into the exhaust path and a fixed central portion between the inlet and outlet defining an opening, the housing assembly includes a cover member mounted on the fixed housing unit for movement from an operative position closing the opening to an open position providing access to an interior space within the fixed housing unit through the opening; and a catalytic carrier assembly having a periphery of a size sufficient to pass through the opening, the catalytic carrier assembly includes a structure having a multiplicity of passages extending therethrough for flow of exhaust gasses therethrough, and a catalyst carried by the structure so as to be contacted by the gasses flowing through the passages; and a mounting assembly to mount the catalytic carrier assembly stably both axially and peripherally within the housing assembly so that exhaust gasses flow only through the passages in operation. The mounting assembly includes an element removably associated with the catalytic carrier assembly when the catalytic carrier assembly is positioned in the interior space of the fixed housing unit and extendable through the opening when the cover member is moved to its open position to enable the catalytic carrier assembly to be moved from the fixed housing unit through the opening.

Another object of the present invention is the provision of apparatus of the type described, which is simple in construction, effective in operation and economical to manufacture and maintain.

These and other objects of the present invention will become apparent during the course of the following detailed description and appended claims.

The invention may be best understood with reference to the accompanying drawings wherein an illustrative embodiment is shown.

BRIEF DESCRIPTION OF THE DRAWINGS

FIG. 5 is a front elevation taken along the line 5—5 of FIG. 1;

FIG. 6 is an enlarged detail view of a catalytic carrier assembly, removed from the apparatus;

FIG. 7 is an enlarged detail view of a loose retainer, removed from the apparatus;

Figure 1:
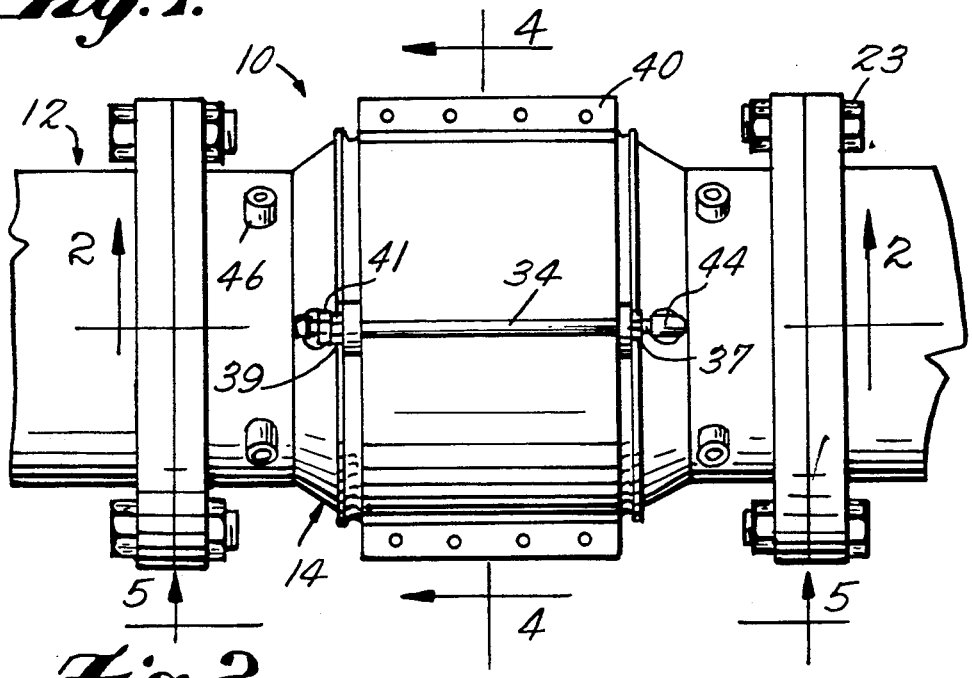
FIG. 1 is a top plan view of a catalytic conversion apparatus embodying the principles of the present invention, showing the same in operating relation within an exhaust gas path of an industrial installation.

Referring now more particularly to the drawings, there is shown therein a catalytic conversion apparatus, generally indicated at 10, which embodies the principles of the present invention. The apparatus 10 is shown in FIG. 1 in an operating condition within an exhaust path, generally indicated at 12, of an industrial installation emitting combustion exhaust gases which must be purified before being discharged from the exhaust path 12 into the atmosphere. The apparatus 10 consists essentially of a housing assembly, generally indicated at 14, one or more catalytic carrier assemblies, generally indicated at 16, and a mounting assembly, generally indicated at 18, which serves to stably support a catalyst carrier assembly 16 within the housing assembly 14 against movement both axially and peripherally in such a way as to permit replacement of a catalyst carrier assembly 16 while retaining a substantial fixed portion of the housing assembly 14 within the exhaust path 12.

Figure 2:
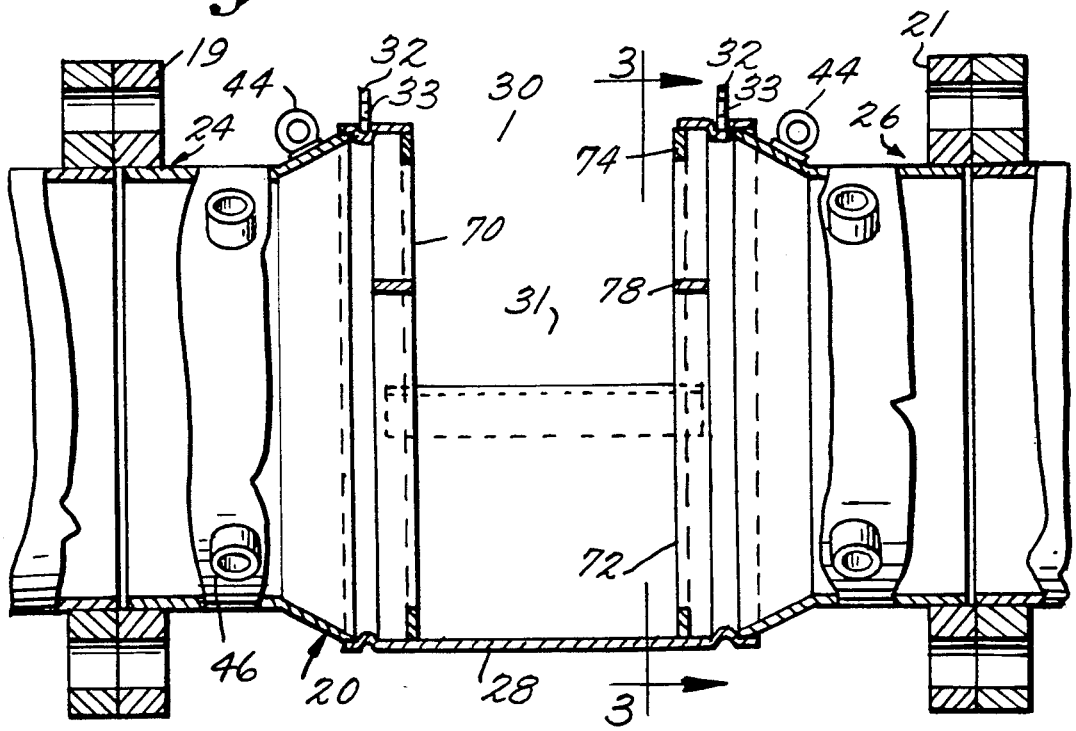
FIG. 2 is an enlarged sectional view taken along the line 2—2 of FIG. 1, having interior elements of the present invention removed.

The housing assembly 14 may be constructed in many typical configurations, however, referring now more particularly to FIGS. 2, 5 and 6, there is shown therein the preferred construction of the housing assembly 14. The housing assembly 14 forms part of the exhaust gas flow path 12 of an industrial installation and comprises a fixed housing unit, generally indicated at 20, and cover member 22, which can be movably fixedly mounted on the fixed housing unit 20. The fixed housing unit 20 includes a first flange 19 attached to a fixed inlet cylindrical portion to receive exhaust gasses, generally indicated at 24, and a second flange 21 attached to a fixed outlet cylindrical portion for exhausting treated gasses into the exhaust path, generally indicated at 26. The first flange 19 and second flange 21 are affixed to the gas flow path 12 by bolts 23. The fixed inlet cylindrical portion 24 and fixed outlet cylindrical portion 26 both gradually expand and are accommodated by a fixed central portion 28. The fixed central portion is disposed between, and affixed to by welding or the like, the fixed inlet cylindrical portion 24 and fixed outlet cylindrical portion 26. The fixed central portion 28 is of U-shaped configuration which defines an upwardly facing opening 30, and an interior space 31. The fixed central portion 28 includes two angled flanges 36 used for affixing the cover member 22 by way of cover flange 40, to the fixed housing unit 20. Affixed by welding or the like to the fixed central portion 28 are two flange elements 32. Each flange element includes a bore 33 therethrough. Disposed through the bore 33 of each flange element 32 is a retaining rod 34. The retaining rod 34 includes a weld nut 37 at one end. The retaining rod 34 is secured to the flange elements by the use of a nut 39, and a locking nut 41. The retaining rod 34 maintains the structural integrity of the apparatus 10 in operation, and must be removed to move the cover member 22, when servicing is required.

A seal 38 is provided between the fixed housing unit 20 and cover member 22 to prevent exhaust gas from escaping from the housing assembly 14. Also, the cover member 22 is sealed to the fixed housing unit 20 by sealing element 42 at each angled flange 36. Disposed at the top periphery of the housing unit 20 are two eyelets 44 used to lift the apparatus 10 while placing the apparatus 10 into the flow path. Placed along the outer periphery of the fixed housing unit 20 are coupling elements 46, which are disposed over a bore into the fixed housing unit 20 and affixed thereto by welding or the like. The coupling elements 46 are furnished to allow sensing devices to be attached to the apparatus 10. The cover member 22 can be moved, thus creating the opening 30 providing access to an interior space 31 in the fixed housing unit 20, to gain access to the catalytic carrier assembly 16.

Figure 4:
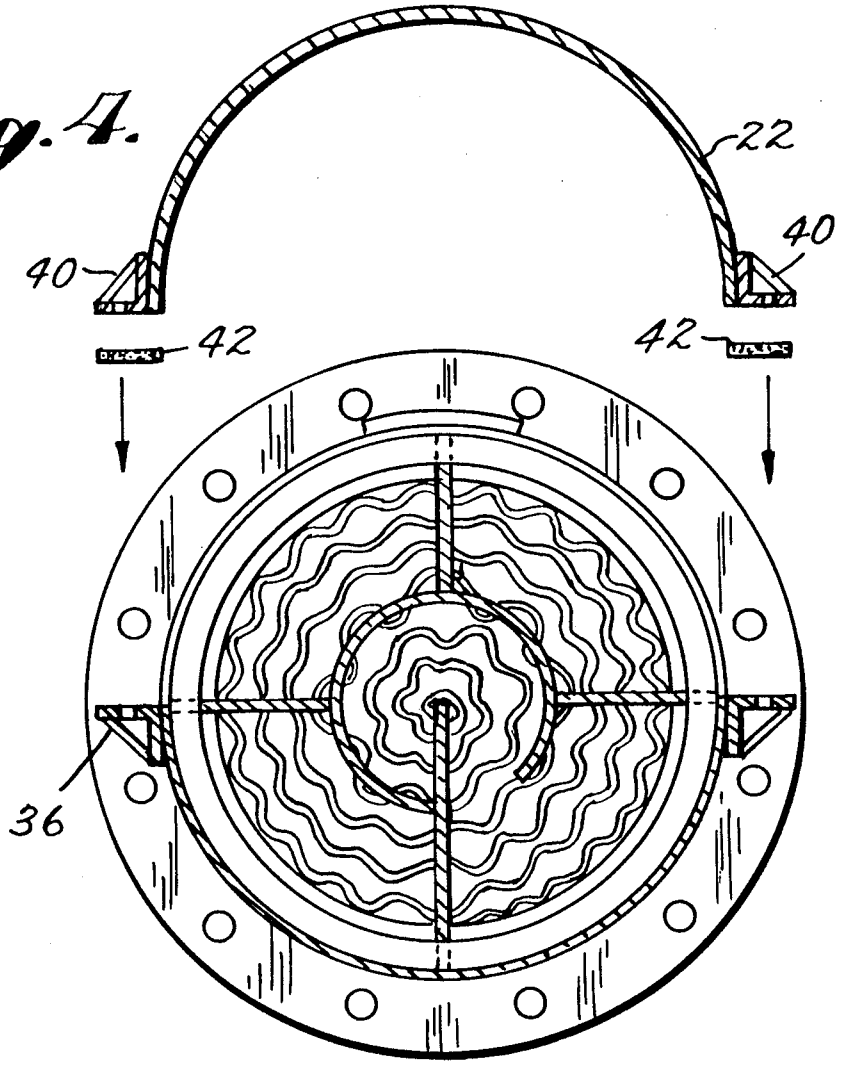
FIG. 4 is a an enlarged sectional view taken along the line 4—4 of FIG. 1, the section being a symmetrical half.

The catalytic carrier assembly 16 can be constructed in many different configurations including ceramic designs, but referring more particularly to FIGS. 5 and 6, the preferred embodiment is shown. The catalytic carrier assembly, generally indicated at 16 is of cylindrical configuration and includes a structure 48, preferably of metal spiral wound construction providing passages 50 for the flow of exhaust gasses therethrough, with the structure 48 in position to contact gasses flowing through the passages 50. FIGS. 4 and 6 depict the passages 50 much larger than actually configured, for schematic purposes. The structure 48 comprises a flat band 53 wound about a corrugated band 54. A suitable catalyst for removing nitrogen oxide or carbon monoxide as taught in the disclosure of U.S. Pat. No. 4,849,185 of which is hereby incorporated by reference into the present specification, is coated on the structure 50.

Referring now to FIGS. 5 and 6, the preferred embodiment of the apparatus 10 shown therein includes a second catalytic carrier assembly 17. The reason for having a pair of catalytic carrier assemblies 16, 17, is to control the volume of catalyst so that laminar flow of the gasses is minimized. Of course, it can be seen that a single catalytic carrier assembly 16 can also be adapted to the present invention. In the preferred configuration, a loose retainer 52, as shown in FIG. 7, comprises a partial ring 55 and three flat bars 56 disposed at the outer peripheral of the partial ring 55, and a end bar 58, disposed at the end of the partial ring 55, and separates catalytic carrier assemblies 16, 17. This loose retainer 52 is configured to be readily extracted from the fixed housing unit 20 by hand or if necessary, by the use of a tool. The loose retainer 52 functions to prevent axial movement of the spiral wound structure 48 during normal operation. The loose retainer 52 also serves to separate the catalytic carrier assemblies 16, 17 to ease in their removal from the fixed housing unit 20. It will be appreciated that a loose retainer 52 is required to be positioned between each pair of catalytic carrier assemblies 16, 17, if more than one pair is required.

Figure 8:
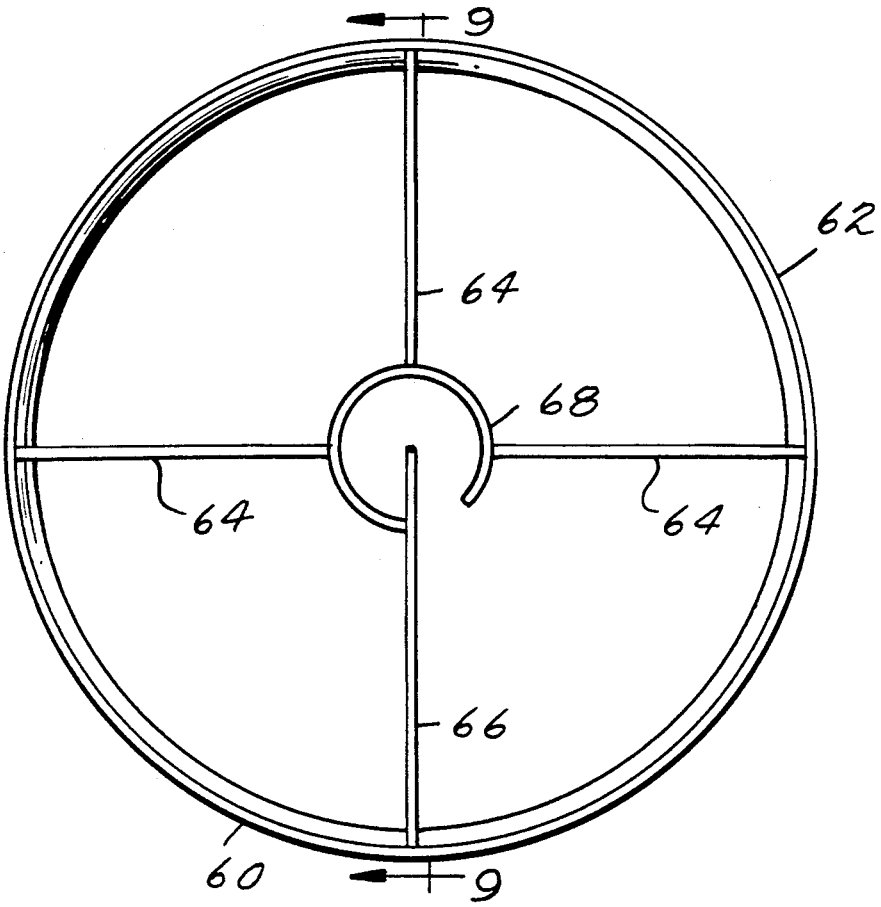
FIG. 8 is an enlarged detail view of an optional spacer, removed from the apparatus.
Figure 9:
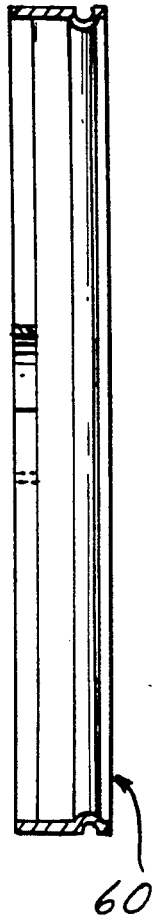
FIG. 9 is a an enlarged sectional view taken along the line 9—9 of FIG. 8.

In applications where only one catalytic carrier assembly 16 is required, the preferred embodiment utilizes a spacer 60, as shown in FIGS. 8 and 9, in place of a second catalytic carrier assembly 17. The spacer 60 comprises a ring member 62 having the same outer diameter as a catalytic carrier assembly. Affixed at one end to the internal diameter of the ring member 62 are three flat members 64, and a vertical bar 66. A ring structure 68 is disposed at the other end of each flat member 64 and vertical bar 66. The spacer 60 functions to replace the second catalytic carrier assembly 17 while providing a means for restricting the movement of the lone catalytic carrier assembly 16 during operation.

Figure 3:
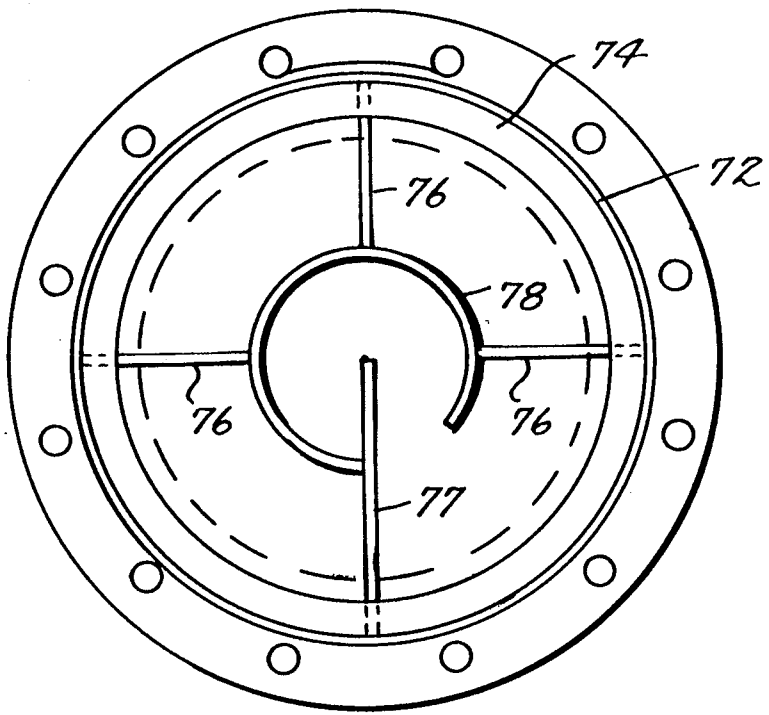
FIG. 3 is an enlarged view taken along the line 3—3 of FIG. 2.

The preferred configuration of the mounting assembly 18 for mounting the catalytic carrier assembly both axially and peripherally within the housing assembly 14 so exhaust gasses flow only through the passages 50 in operation, is depicted in FIGS. 2, 3, and 5. Referring now more particularly to FIGS. 2 and 3, the mounting assembly is comprised of retaining elements 70, 72 to axially support the catalytic carrier assembly. The retaining elements 70, 72 are affixed to each end of the fixed central portion 28 of the fixed housing unit 20 by attaching to the affixing member 34 by welding or the like. The retaining elements 70, 72 are disposed in the fixed housing unit 20 so as to define the limits of the interior space 31. Each retaining element 70, 72 comprises a band 74 disposed along the outer edge of the retaining elements 70, 72, three bars 76 and a strip 77, each having one end affixed to the band 74. The remaining end of each of the three bars 76 is affixed to the outer periphery of a partial loop member 78, with the strip 77 affixed to the end of the partial loop member 78 and extending to the center of the partial loop member 78, so as to dispose the partial loop member centrally within the fixed housing unit 20 in the exhaust path 12. Referring to FIG. 5, the catalytic carrier assembly 16 having end 80 abuts retaining element 70, while the second catalytic carrier assembly 17 having end 82 abuts retaining element 72. The fixed retaining elements 70, 72 are exposed to high temperature exhaust gasses and function to axially retain the catalytic carrier assemblies 16, 17 and to compensate for radial temperature expansion. When a pair of catalytic carrier assemblies 16, 17 or a catalytic carrier assembly 16 and spacer 60 are utilized, the loose retainer 52 is disposed between catalytic carrier assemblies 16, 17, or catalytic carrier assembly 16 and spacer 60. The loose retainer 52 provides axial support to the catalytic carrier assemblies in operation.

As shown in FIGS. 5 and 6, the preferred embodiment the mounting assembly 18 also includes a removing means 84. The removing means 84 is disposed peripherally about each catalytic carrier assembly 16, 17 so each catalytic carrier assembly 16, 17 can be supported and removed in a generally vertical direction from the housing unit 20 for servicing, without being damaged, when the apparatus 10 is mounted in a preferred horizontal orientation within the flow path, with the cover member 22 in an upward position. The removing means 84 is also utilized about the spacer 60 when used in place of the second catalytic carrier member 17, which permits the spacer 60 to be removed from the fixed housing unit 20 in a generally vertical direction. The preferred embodiment of each removing means 84 as shown in FIGS. 5 and 6 is a generally rectangular configuration disposed about the periphery of each catalytic carrier member 16, 17 or spacer 60.

In accordance with the principles of the present invention, it is greatly preferred that the mounting assembly 18 include the feature of providing removing members 86 to facilitate the replacement of the catalytic carrier assemblies 16 and 17 within the fixed housing unit 20. As shown, a removing member 86 is provided at the two ends of each removing means 84. The preferred configuration of the removing means 84 is desirable since the weight of the catalytic carrier assembly 16 is distributed uniformly, thus preventing the catalytic carrier assembly 16 from being damaged upon removal of the fixed housing unit 20. Furthermore, as shown in FIG. 6, the removing means 84 has a first end 88 and a second end 90 which abut, so as to be cooperatively associated with the cover member 22 in operation. In the best mode, disposed about the periphery of the removing means 84 and loose retainer 52 is a high temperature seal 92 composed of a pad of compressible fibrous refractory material (e.g., Fiberfrax®) having a generally rectangular configuration having abutting ends so exhaust gasses flow only through the passages 50 of each catalytic carrier assembly 16, 17 in operation.

When servicing of the catalytic carrier assemblies 16, 17 is required, the cover member 22 must be moved to create the opening 30 providing access to the interior space 31 in the fixed housing unit 20 to access the catalytic carrier assemblies 16, 17. Once the cover member 22 is moved, the high temperature seal 92 is accessible and can be moved to reveal the removing means 84 and the loose retainer 52. The loose retainer 52 is first removed from the fixed housing unit 20 which permits the catalytic carrier assemblies 16, 17 to be removed more easily. The removing means 84 may now extend through the opening 30 created in the fixed housing unit 20 so the removing members 86 may be utilized to remove the catalytic carrier assemblies 16, 17 from the interior space 31, with the high temperature seal 92 remaining in the fixed housing unit 20. Serviced catalytic carrier assemblies may now be inserted into the fixed housing unit 20 in place of the depleted catalytic carrier assemblies 16, 17.

The apparatus 10 is preferably mounted horizontally within the flow path, with the cover member oriented in an upward position. However, it can be appreciated that the apparatus may be mounted vertically within the flow path, or in a manner in which there is a vertical component to mounting. In addition, the cover member 22 need not be in an upwardly facing orientation, since the apparatus 10 may be rotated in any orientation about the axis of flow, when mounted. For instance, the apparatus 10 may be mounted in a vertically gas flow path, with the cover member 22 being positioned in the horizontal plane. The access and removal of the catalytic carrier assemblies 16,17 is similar to that of the preferred mounting. Once the cover member 22 is moved to an open position, the removing members 86 of the removing means 84 may be used to remove the catalytic carrier assemblies 16,17 from the fixed housing unit 20.

When the apparatus 10 is mounted in a horizontal flow path with the cover member 22 disposed in a downward orientation, it may be necessary to use the removing members 86 of the removing means 84 to move the catalytic carrier assemblies 16,17 from the fixed housing unit 20, if the catalytic carrier assemblies 16,17 are tightly fitted into the fixed housing unit 20. In situations when the catalytic carrier assemblies are not tightly fitted into the fixed housing unit 20 the force of gravity alone may move the assemblies from the housing. In this situation, the removing means 84 may be omitted from the apparatus 10 since it is not needed to remove the assemblies, but it is preferable to include the removing means 84 to maintain the integrity of the catalytic carrier assemblies in operation.

It can be seen that the apparatus 10 of the present invention provides an effective means of performing catalytic treatment of exhaust gasses flowing in a large volume flow path. The ability to easily remove the catalytic carrier assembly while at the same time allowing the fixed housing unit to remain affixed in the exhaust path is a particularly desirable feature since periodic servicing of the apparatus may be performed with minimum downtime.

It thus will be seen that the objects of this invention have been fully and effectively accomplished. It will be realized, however, that the foregoing preferred embodiment of the present invention has been shown and described for the purposes of illustrating the structural and functional principals of the present invention and is subject to change without departure from such principles. Therefore, this invention includes all modifications encompassed within the spirit of the following claims.

What is claimed is:

1. Apparatus for effecting high temperature catalytic conversion treatment of combustion exhaust gasses flowing in an exhaust path of an industrial installation comprising:

a housing assembly including a fixed housing unit forming a fixed part of a gas exhaust path having a fixed inlet to receive the gasses in the exhaust path and a fixed outlet for exhausting treatment gasses into the exhaust path and a fixed central portion between said inlet and outlet defining an opening, said housing assembly including cover means mounted on said fixed housing unit for movement from an operative position closing said opening an open position providing access to an interior space within said fixed housing unit through said opening, catalytic carrier means having a cylindrical periphery of a size sufficient to pass through said opening, said catalytic carrier means including a generally cylindrical structure having a multiplicity of passages extending therethrough for flow of exhaust gasses therethrough, and a catalyst carried by said structure so as to be contacted by the gasses flowing through said passages, and means for mounting said catalytic carrier means stably both axially and peripherally within said housing assembly so that exhaust gasses flow only through said passages in operation, said mounting means being constructed and arranged to position the cylindrical periphery of said catalytic carrier means within said fixed housing unit when said cover means is in said operative position, said mounting means being constructed and arranged to facilitate removal of said catalytic carrier means from the interior space of said fixed housing unit through said opening when said cover means is moved to said open position for servicing while said fixed inlet, said fixed outlet and said fixed central portion remain fixed within the gas flow path to receive another catalytic carrier means.

2. An apparatus as defined in claim 1 wherein said catalytic carrier means includes a pair of axially spaced catalytic carrier assemblies positioned in said interior space of said fixed housing unit so as to be removable through said opening, said mounting means including means for separating said catalytic carrier assemblies configured so as to be easily removed from said fixed housing unit and sealing means disposed peripherally about said pair of catalytic carrier assemblies.

3. An apparatus as defined in claim 2 wherein said separating means comprises a partial ring element having two ends, said ring element having three bar members spaced 45 degrees apart and affixed to a periphery of said ring element, said ring element having a fourth bar element affixed to one end thereof and extending to a central portion of said ring element.

4. An apparatus as defined in claim 2 wherein said sealing means comprises a pad of compressible fibrous refractory material having abutting ends wrapped around the periphery of said pair of catalytic carrier assemblies.

5. Apparatus as defined in claim 2 wherein said mounting means includes removing means constructed and arranged to permit said catalytic carrier means to be positioned in the interior space of said fixed housing unit and to extend through said opening when said cover means is moved to said open position to facilitate removal of said catalytic carrier means from said fixed housing unit through said opening.

6. Apparatus as defined in claim 5 wherein said fixed housing unit comprises:

a first flange disposed at said fixed inlet, and a second flange disposed at said fixed outlet utilized to affix said fixed housing unit within said exhaust flow path, said first flange affixed to an inlet cylindrical portion which gradually diverges toward and is fixed to said central portion, said central portion for supporting said catalytic carrier means, said central portion affixed to an outlet cylindrical portion, said outlet cylindrical portion gradually converging toward and affixed to said second flange, said central portion including flanges for affixing said cover means thereto.

7. Apparatus as defined in claim 6 wherein said cover means includes a flange disposed at each end thereof arranged for affixing said cover means to said housing unit.

8. Apparatus as defined in claim 1 wherein said fixed housing unit comprises:

a first flange disposed at said fixed inlet, and a second flange disposed at said fixed outlet utilized to affix said fixed housing unit within said exhaust flow path, said first flange affixed to an inlet cylindrical portion which gradually diverges toward and is fixed to said central portion, said central portion for supporting said catalytic carrier means, said central portion affixed to an outlet cylindrical portion, said outlet cylindrical portion gradually converging toward and affixed to said second flange, said central portion including flange members for affixing said cover means thereto.

9. Apparatus as defined in claim 1 wherein said cover means includes a flange disposed at each end thereof utilized when affixing said cover means to said housing unit.

10. Apparatus for effecting high temperature catalytic conversion treatment of combustion exhaust gasses flowing in an exhaust path of an industrial installation comprising:

a housing assembly including a fixed housing unit forming a fixed part of a gas exhaust path having a fixed inlet to receive the gasses in the exhaust path and a fixed outlet for exhausting treated gasses into the exhaust path and a fixed central portion between said inlet and outlet defining an opening, said housing assembly including cover means mounted on said fixed housing unit for movement from an operative position closing said opening to an open position providing access to an interior space within said fixed housing unit through said opening, catalytic carrier means having a periphery of a size sufficient to pass through said opening, said catalytic carrier means including a structure having a multiplicity of passages extending therethrough for flow of exhaust gasses therethrough, and a catalyst carried by said structure so as to be contacted by the gasses flowing through said passages, and means for mounting said catalytic carrier means stably both axially and peripherally within said housing assembly so that exhaust gasses flow only through said passages in operation, said mounting means including removing means constructed and arranged to permit said catalytic carrier means to be positioned in the interior space of said fixed housing unit and to extend through said opening when said cover means is moved to said open position to facilitate removal of said catalytic carrier means to be removed from said fixed housing unit through said opening.

11. An apparatus as defined in claim 10 wherein said catalytic carrier means includes a pair of axially spaced catalytic carrier assemblies positioned in said interior space of said fixed housing unit so as to be removable through said opening, said mounting means including means for separating said catalytic carrier assemblies configured so to be easily removed from said fixed housing unit, said removing means disposed peripherally about each of said catalytic carrier assemblies.

12. An apparatus as defined in claim 11 wherein said separating means comprises a partial ring element having two ends, said ring element having three bar members spaced 45 degrees apart and affixed to a periphery of said ring element, said ring element having a fourth bar element affixed to one end thereof and extending to a central portion of said ring element.

13. Apparatus as defined in claim 12 wherein said catalytic carrier means has a cylindrical periphery, and said structure being of generally cylindrical configuration.

14. An apparatus as defined in claim 11 wherein said mounting means further includes sealing means comprising a pad of compressible fibrous refractory material having abutting ends wrapped around a periphery of said pair of catalytic carrier assemblies.

15. Apparatus as defined in claim 10 wherein said fixed housing unit comprises:

a first flange disposed at said fixed inlet, and a second flange disposed at said fixed outlet utilized to affix said fixed housing unit within said exhaust flow path, said first flange affixed to an inlet cylindrical portion which gradually diverges toward and is fixed to said central portion, said central portion for supporting said catalytic carrier means, said central portion affixed to an outlet cylindrical potion, said outlet cylindrical portion gradually converging toward and affixed to said second flange, said outlet cylindrical portion affixed to said second flange, said central portion including flange members for affixing said cover means thereto.

* * * * *